US005141452A

United States Patent [19]

Yoneda et al.

[11] Patent Number: 5,141,452

[45] Date of Patent: Aug. 25, 1992

[54] ELECTRICAL CONNECTOR

[75] Inventors: Takahiro Yoneda, Kanagawa; Takayoshi Endo, Shizuoka; Hitoshi Saito, Shizuoka; Kimihiro Abe, Shizuoka, all of Japan

[73] Assignees: Nissan Motor Co., Ltd., Yokohama; Yazaki Corporation, Tokyo, both of Japan

[21] Appl. No.: 671,416

[22] Filed: Mar. 20, 1991

[30] Foreign Application Priority Data

Mar. 22, 1990 [JP] Japan ..... 2-28190[U]
May 22, 1990 [JP] Japan ..... 2-52636[U]

[51] Int. Cl.[5] ..... H01R 13/40
[52] U.S. Cl. ..... 439/595; 439/752
[58] Field of Search ..... 439/595, 596, 752, 278, 439/282, 599

[56] References Cited

U.S. PATENT DOCUMENTS 4,200,350 4/1980 Zimmerman, Jr. ..... 439/752 X
4,660,915 4/1987 Mantlik ..... 439/595
4,758,182 7/1988 Anbo et al. .
4,758,183 7/1988 Aoyama .
4,867,705 9/1989 Yuasa ..... 439/596 X
4,946,398 8/1990 Takenouchi et al. ..... 439/752 X

FOREIGN PATENT DOCUMENTS 8600466.2 3/1986 Fed. Rep. of Germany .

*Primary Examiner*—Neil Abrams
*Assistant Examiner*—Khiem Nguyen
*Attorney, Agent, or Firm*—Lowe, Price, LeBlanc & Becker

[57] ABSTRACT

An electrical connector assembly includes a connector housing, a terminal support and a terminal holder. The terminal support is integrally connected to the connector housing. The terminal support has therein a plurality of abreast arranged passages to receive a plurality of terminals. The terminal holder has a through bore which is so sized as to receive therein the terminal support. The terminal holder is formed at rear portions thereof a pair of openable portions. The terminal holder is to be incompletely and completely latched to one of the connector housing and the terminal support with the openable portion assuming the open and closed conditions, respectively.

23 Claims, 7 Drawing Sheets

ELECTRICAL CONNECTOR

BACKGROUND OF THE INVENTION

1. Field of the Invention

The present invention relates in general to electrical connectors, and more particularly, to electrical connectors of a type which has a double lock mechanism for assuredly holding electrical terminals in position.

2. Description of the Prior Art

In order to clarify the task of the present invention, one conventional electrical connector of the above-mentioned type will be outlined with reference to FIGS. 14, 15 and 16 of the accompanying drawings.

Referring to FIG. 14, there is shown a male part of the electrical connector which is to be mated with a female part (not shown). The male part comprises a plastic housing 10 which has a front smaller portion 12 and a rear larger portion 14. The front smaller and rear larger portions 12 and 14 are united. They are generally rectangular in shape and have therein a plurality of abreast arranged passages 20.

For defining the passages 20, a terminal support 18 having abreast arranged channels is installed in the housing 10, which is integral with the same. The channels are so sized as to receive therein hollow terminal pins 22 (see FIGS. 15 and 16).

As is seen from FIGS. 15 and 16, the rear larger portion 14 of the housing 10 is integrally formed with upper and lower hinged portions 24 and 26. The hinge portions are denoted by numeral 28. The upper and lower portions 24 and 26 are thus pivotal between an opened position as is seen from FIG. 15 and a closed position as is seen from FIG. 16. A known lock means is provided for keeping the closed position of the upper and lower portions 24 and 26.

The upper and lower portions 24 and 26 are respectively formed with laterally extending and projected portions 30 (only one is shown). As is seen from FIG. 16, when the upper and lower portions 24 and 26 assume the closed position, each projected portion 30 has a vertical front surface 30*a*.

The terminal support 18 is formed at each passage 20 with a rearwardly extending flexible arm 31 which has at the rear end thereof an upward projection 32.

Each terminal 22 is an elongate member, and is formed at a rear portion thereof with a smaller projection 34 which is lockably engageable with the projection 32 and at a rear end thereof with a larger projection 36. The smaller and larger projections 34 and 36 are positioned at diametrically opposed portions of the terminal 22. The larger projection 36 has a generally vertical rear end surface 36*a*.

Installation of the terminals 22 to the electrical connector is made as follows.

First, as is seen from FIG. 15, the upper and lower portions 24 and 26 of the housing 10 are opened. Then, the terminals 22 are inserted into the passages 20 of the terminal support 18 from the rear open end of the housing 10. The insertion of the terminals 22 is continued until they come to their proper positions. Upon reaching, the smaller projections 34 of the terminals 22 are latchingly engaged with the projections 32 of the terminal support 18 and thus, the terminals 22 are latched in the passages 20. Then, as is seen from FIG. 16, the upper and lower portions 24 and 26 are pivoted to assume the closed position. With this, the vertical front surfaces 30*a* of the projected portions 30 of the upper and lower portions 24 and 26 are brought into abutment with the rear end surfaces 36*a* of the projections 36 of the terminals 22. Thus, the terminals 22 are locked double by the projections 32 as well as the projected portions 30, and thus, the terminals 22 are assuredly held in the passages 20.

However, due to its inherent construction, the above-mentioned conventional electrical connector has the following drawback.

That is, if the closing pivoting of the upper and lower portions 24 and 26 is carried out with some of the terminals 22 kept inproperly set in the passages 20, the closing pivoting is not permitted because of an abnormal abutment of the projections 30 against the projections 36. If, under such condition, the upper and lower portions 24 and 26 are applied with a greater force for intending the closed position thereof, the terminals 22 may be damaged.

SUMMARY OF THE INVENTION

Therefore, it is an object of the present invention to provide an electrical connector, which is free of the above-mentioned drawback.

According to the present invention, there is provided an electrical connector assembly, which includes a connector housing, a terminal support integrally connected to the connector housing, the terminal support having therein a plurality of abreast arranged passages, a plurality of terminals adapted to be received in the passages, a terminal holder having a through bore which is so sized as to receive therein the terminal support, a pair of openable portions defined by rear portions of the terminal holder, the openable portions having a closed condition wherein the openable portions partially close the rear open end of the through bore and an open condition wherein the openable portions fully open the rear open end, first latching means for incompletely latching the terminal holder to one of the connector housing and the terminal support when the terminal holder on the terminal support is slid, with the openable portion assuming the open condition, to a first given position relative to the terminal support, the first given position permitting easy insert of the terminals into the passages of the terminal support from the rear open end, and second latching means for completely latching the terminal holder to one of the connector housing and the terminal support when the terminal holder is slid, with the openable portions assuming the closed condition, from the first given position to a second given position to fully receive the terminal support.

BRIEF DESCRIPTION OF THE DRAWINGS

Other objects of the present invention will become apparent from the following description when taken in conjunction with the accompanying drawings, in which:

FIG. 2 is a perspective view of the electrical connector of the first embodiment, showing a condition wherein the terminal holder is half or incompletely coupled with the paired terminal supports and terminal holding portions are opened, FIG. 2 being a view taken from a direction opposite to the direction from which FIG. 1 is taken;

DETAILED DESCRIPTION OF THE INVENTION

Referring to FIGS. 1 to 6, there is shown a female part of an electrical connector of a first embodiment of the present invention, which is to be mated with a male part (not shown).

Figure 1:
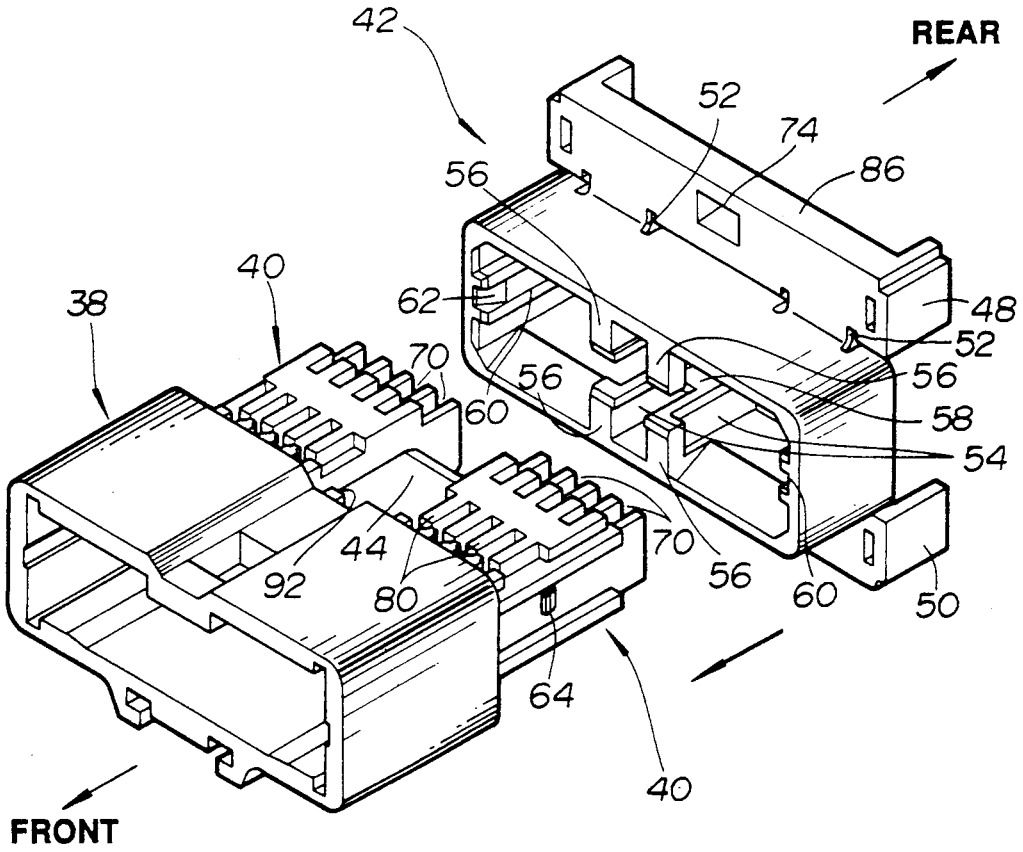
FIG. 1 is a perspective view of an electrical connector of a first embodiment of the present invention, showing a condition wherein a terminal holder is separated from paired terminal supports of a housing.

As is seen from FIG. 1, the female part is made of plastic and includes a housing 38, a pair of terminal supports 40 and a terminal holder 42. The terminal supports 40 are united to each other by a middle depressed portion 44 interposed therebetween. The housing 38 has a rectangular cavity and a rear vertical wall 46 (see FIG. 4, 5 or 6) with which the terminal supports 40 and the middle depressed portion 44 are integral. The housing 38 and the terminal holder 42 are generally rectangular in shape. The terminal holder 42 has a rectangular bore formed therethrough.

Figure 2:
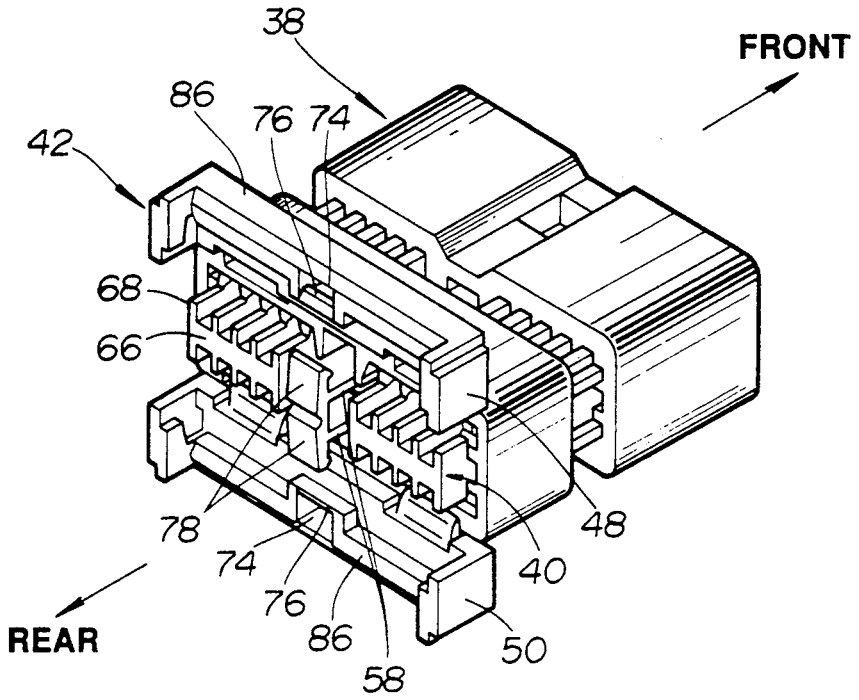
Figure 3:
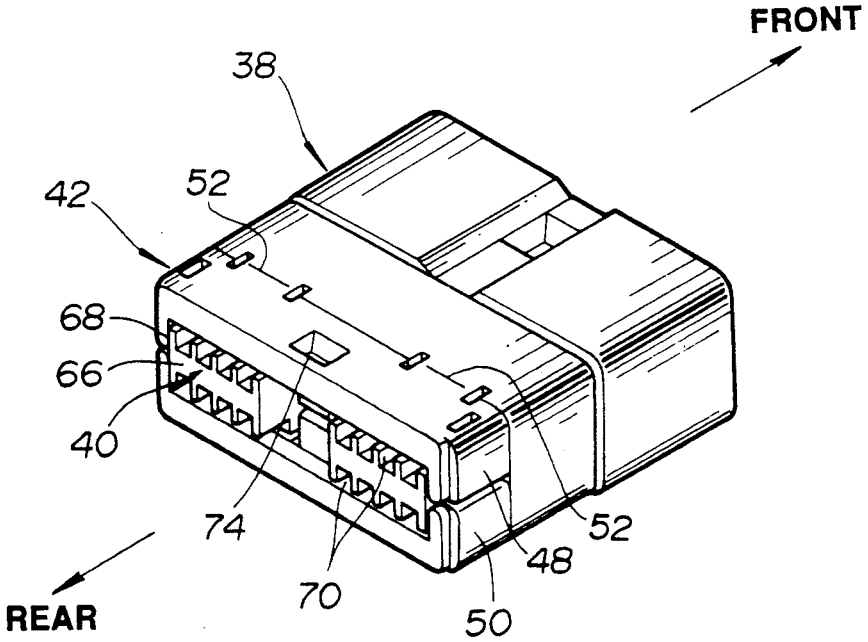
FIG. 3 is a view similar to FIG. 2, but showing a condition wherein the terminal holder is completely coupled with the terminal supports and the terminal holding portions are closed.

The terminal holder 42 is formed at a rear portion thereof with upper and lower terminal-holding portions 48 and 50 which are pivotal between opened positions and closed positions by means of respective integral hinges 52 therebetween (see FIGS. 2 and 3). When the upper and lower terminal-holding portions 48 and 50 are released, they are forced to assume opened positions due to biasing force of the hinges 52.

As is best seen from FIG. 1, the terminal holder 42 is formed at middle portions of the upper and lower inner surfaces thereof with upper and lower paired projections 54. The paired projections 54 are axially extended and inwardly projected. The paired projections 54 of each surface have at front ends laterally outwardly bent portions 56. The upper and lower paired projections 54 are formed at rear portions thereof with respective horizontal plates 58 (see FIG. 2). These plates 58 are connected through a vertically extending member as will be described hereinafter.

The terminal holder 42 is formed at both inner side surfaces with axially extending grooves 60. The grooves 60 have at front ends thereof respective projections 62. Each projection 62 has a tapered front surface and a vertical rear surface.

The terminal supports 40 are formed at both side surfaces thereof with projections 64. Each projection 64 has a vertical front surface and a tapered rear surface so as to be lockably engageable with the projection 62 of the terminal holder 42. Thus, upon coupling, relative axial movement between the terminal supports 40 and the terminal holder 42 is suppressed.

As is seen from FIGS. 2 and 3, each terminal support 40 includes horizontal and vertical partitioning walls 66 and 68 which define upper and lower passages 70 for receiving terminals 72 therein.

The upper and lower terminal-holding portions 48 and 50 are respectively formed at middle portions thereof with rectangular openings 74. Each opening 74 has an engaging portion 76 (see FIGS. 4, 5 or 6).

As is seen from FIG. 2, the aforementioned horizontal plates 58 of the upper and lower paired projections 54 are rearwardly extended and integrally formed at rear ends thereof with vertically extending engaging portions 78 which are integral and flexible. The engaging portions 78 are lockably engageable with the engaging portions 76 so as to maintain the closed positions of the upper and lower terminal-holding portions 48 and 50.

Figure 4:
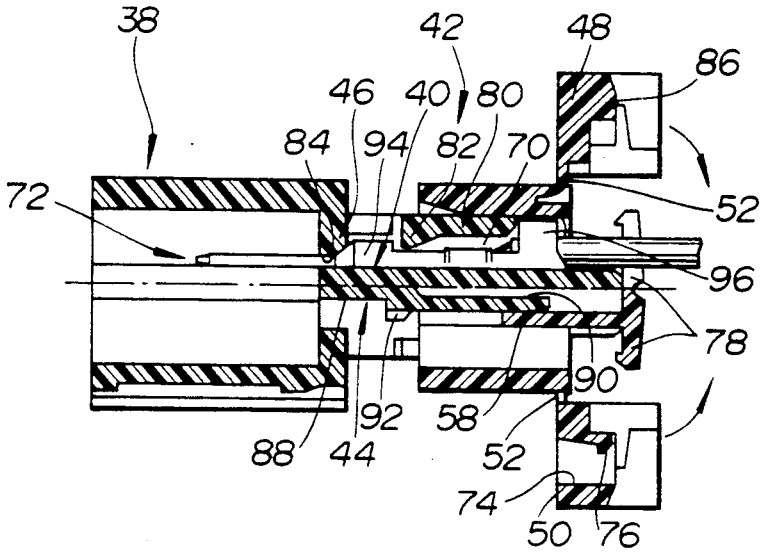
FIG. 4 is a vertically sectional view of the electrical connector of the first embodiment, showing a condition wherein the terminal holding portions are opened and the terminal holder is in an incomplete coupling with the terminal supports.
Figure 5:
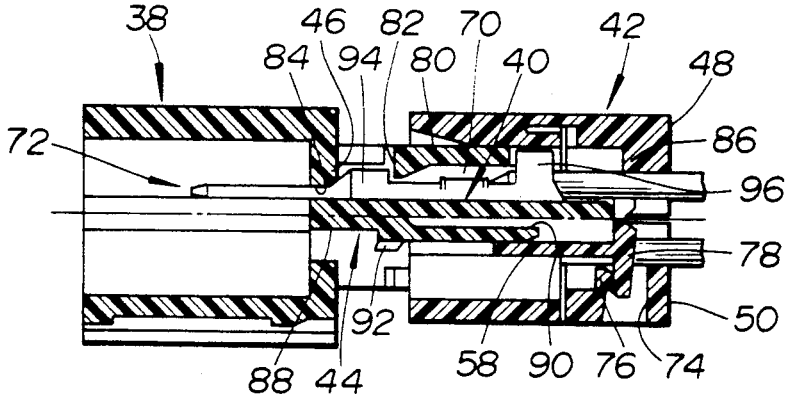
FIG. 5 is a view similar to FIG. 4, but showing a condition wherein the terminal holding portions are closed.
Figure 6:
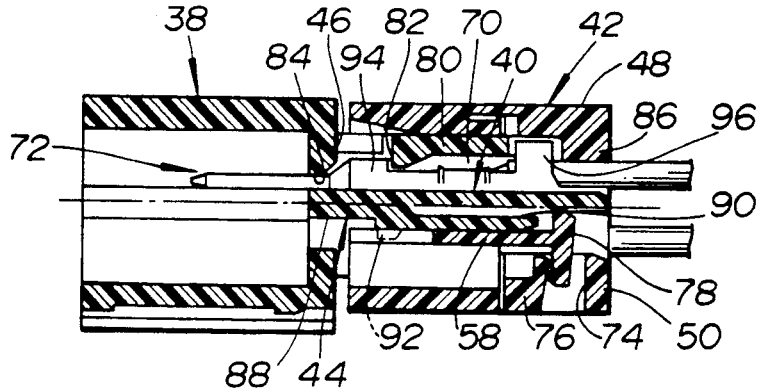
FIG. 6 is a view similar to FIG. 5, but showing a condition wherein the terminal holder is in a complete coupling with the terminal supports.

As is seen from FIGS. 4, 5 and 6, the terminal support 40 is formed at each terminal passage 70 with a flexible arm 80 which has an inwardly projected portion 82 (see FIG. 1). The projected portion 82 of the arm 80 is used for locking the terminal 72 as will become apparent as the description proceeds.

The rear wall 46 of the housing 38 is formed with upper and lower holes 84 for permitting insertion of leading portions of the terminals 72 into the housing 38 therethrough.

The upper and lower terminal-holding portions 48 and 50 are respectively formed at rear ends thereof with projected portions 86 which are inwardly bent and laterally extended.

The aforementioned middle depressed portion 44 of the terminal supports 40 includes a horizontal front portion 88 and a pair of horizontal flat portions 90 which are spaced from each other. Upon coupling between the terminal supports 40 and the terminal holder 42, the flat portions 90 are smoothly received in a space defined between the upper and lower paired projections 54 of the terminal holder 42. The flat portions 90 are integrally formed at their front ends with two projections 92 respectively which are outwardly projected.

The terminal 72 is an elongate metal member and has projections 94 and 96 at a middle portion and a rear end thereof, respectively.

Installation of the terminals 72 to the electrical connector will be described with reference to the drawings.

First, as is seen from FIG. 1, the upper and lower terminal-holding portions 48 and 50 of the terminal holder 42 are opened. Then, the terminal holder 42 is slidably received on the paired terminal supports 40 and brought to an incompletely latched position wherein the projections 62 of the terminal holder 42 and the projections 64 of the terminal supports 40 are practically engaged. Then, the terminals 72 are inserted into the passages 70 of the terminal supports 40 from the rear open ends of the passages 70. This inserting movement is continued until the projections 94 of the terminals 72 ride over the inwardly projected portions 82 of the terminal supports 40. That is, under this condition, the projections 94 of the terminals 72 are held between the rear wall 46 of the housing 38 and the projected portions 82 of the terminal supports 40, as is shown in FIG. 4.

Then, as is seen from FIG. 5, the upper and lower terminal-holding portions 48 and 50 are pivoted to assume the closed positions. With this, the engaging portions 76 of the upper and lower terminal-holding portions 48 and 50 are engaged with the engaging portions 78 of the terminal holder 42 to maintain the closed positions of these portions 48 and 50. Under this condition, the vertical front surfaces of the projected portions 86 of the terminal holder 42 face toward rear ends of the terminals 72 with a certain clearance therebetween.

Then, as is seen from FIG. 6, the terminal holder 42 is forwardly slid to a so-called completely latched position wherein the outwardly bent portions 56 of the terminal holder 42 are lockably engaged with the projections 92 of the terminal support 40. With this, the terminal holder 42 is tightly fixed to the terminal supports 40. Under this condition, the vertical front surfaces of the projected portions 86 of the terminal holder 42 are in abutment with or at least positioned adjacent to the rear ends of the projections 96 of the terminals 72.

Referring to FIGS. 7 to 13, there is shown a female part of an electrical connector of a second embodiment of the present invention, which is to be mated with a male part (not shown).

Figure 7:
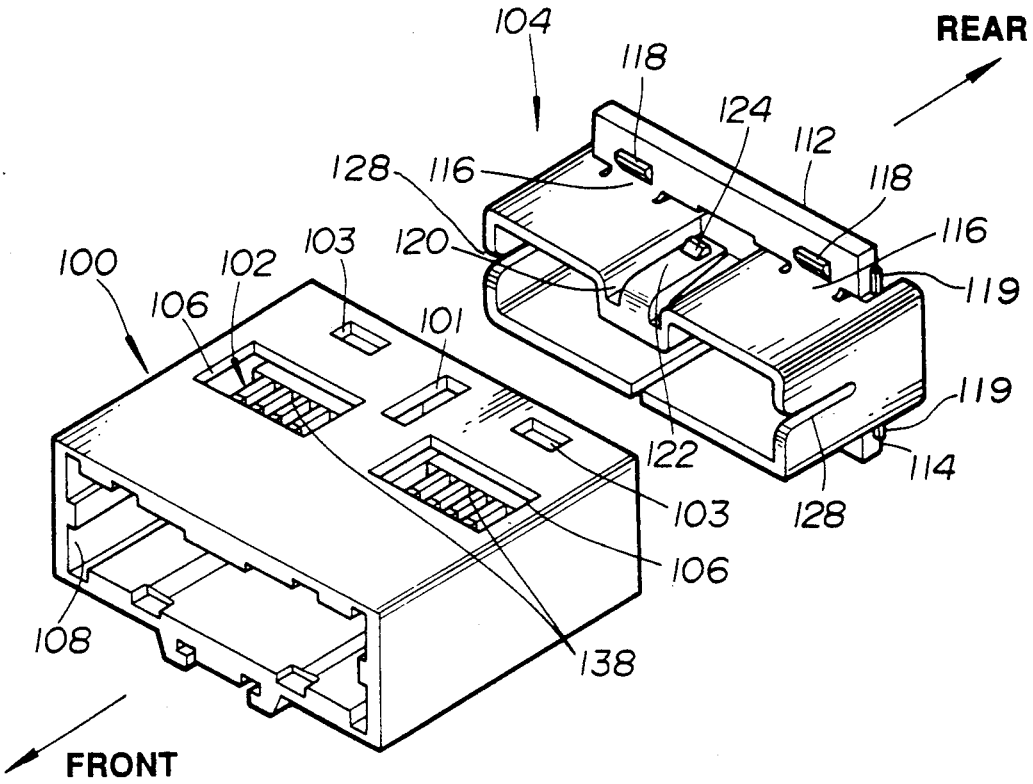
FIG. 7 is a view similar to FIG. 1, but showing a second embodiment.

As is seen from FIG. 7, the female part is made of plastic and includes a housing 100, a terminal support 102 and a terminal holder 104. The housing 100 and the terminal holder 104 are generally rectangular in shape. The housing 100 has a middle vertical wall which defines therein a front rectangular cavity 108 and a rear rectangular cavity 110 (see FIG. 11, 12, or 13). The terminal support 102 is spacedly arranged in the rear cavity 110 of the housing 100 and extends axially from the middle vertical wall 105 to the rear end of the housing 100.

The housing 100 is formed at a rear middle portion of the upper surface thereof with a rectangular opening 101 and at rear portions of the upper and lower surfaces thereof with rectangular openings 103. The housing 100 is formed at a middle portion of the upper surface thereof with a pair of openings 106 and at a middle portion of the lower surface thereof with an opening 108 (see FIG. 11, 12 or 13).

The terminal holder 104 is formed at a rear portion thereof with upper and lower terminal-holding portions 112 and 114 which are pivotal between opened positions and closed positions by means of respective integral hinges 116 therebetween. When the upper and lower terminal-holding portions 112 and 114 are released, they are forced to assume the opened positions due to biasing force of the hinges 116.

The upper and lower terminal-holding portions 112 and 114 are formed with projections 118 each of which has a front tapered surface and a rear vertical surface so as to be lockably engageable with each opening 103 of the housing 100. Thus, upon coupling, relative axial movement between the housing 100 and the terminal holder 104 is suppressed.

The upper and lower terminal-holding portions 112 and 114 are formed at both side surfaces with flexible projections 119. The terminal holder 104 is formed at rear upper and lower ends of the inner side surfaces thereof with rectangular projections (not shown) which are axially extended. The rectangular projections are lockably engageable with the flexible projections 119 so as to maintain the closed positions of the upper and lower terminal-holding portions 112 and 114.

The terminal holder 104 is formed at a middle portion of the upper surface with a rectangular concave portion 120 which is axially extended. The terminal holder 104 is formed at the concave portion 120 with a generally L-shaped arm 122 which is flexible. The arm 122 has a front vertical portion and a rearwardly extending horizontal portion. The arm 122 is formed at a rear portion thereof with a projection 124 which is upwardly projected from the upper surface of the terminal holder 104 and has a front tapered surface and a rear vertical surface so as to be lockably engageable with the opening 101 of the housing 100.

The housing 100 is respectively formed at front inner side surfaces of the rear cavity 110 thereof with ridges (not shown) which are axially extended.

The terminal holder 104 is respectively formed at both front sides thereof with notches 128 which are slidably engageable with the ridges of the housing 100.

Figure 8:
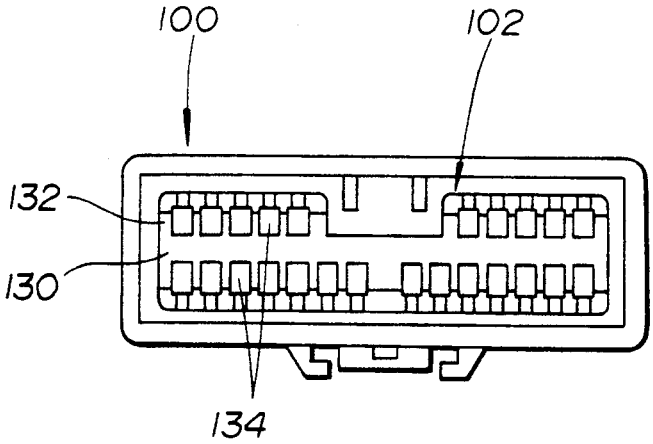
FIG. 8 is a rear view of a housing and a terminal support of the second embodiment.
Figure 9:
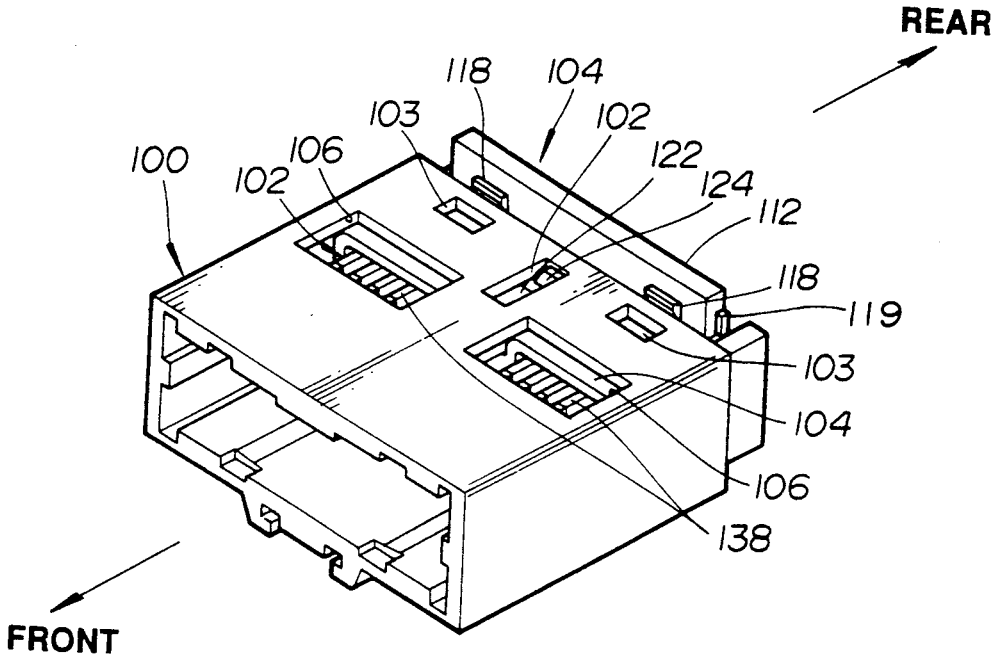
FIG. 9 is a perspective view of the electrical connector of the second embodiment, showing a condition wherein the terminal holder is in an incomplete coupling with the housing.

As is seen from FIG. 8, the terminal support 102 includes horizontal and vertical partitioning walls 130 and 132 which define upper and lower passages 134 for receiving terminals 136 therein.

Figure 11:
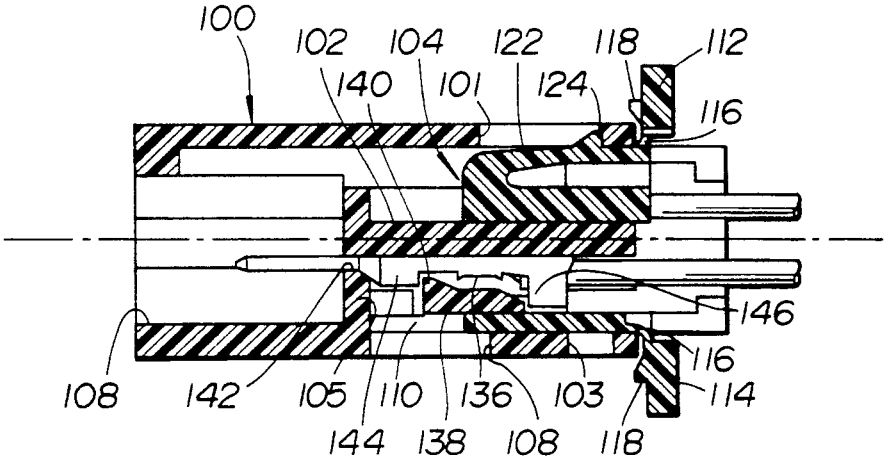
FIG. 11 is a view similar to FIG. 4, but showing the second embodiment.
Figure 12:
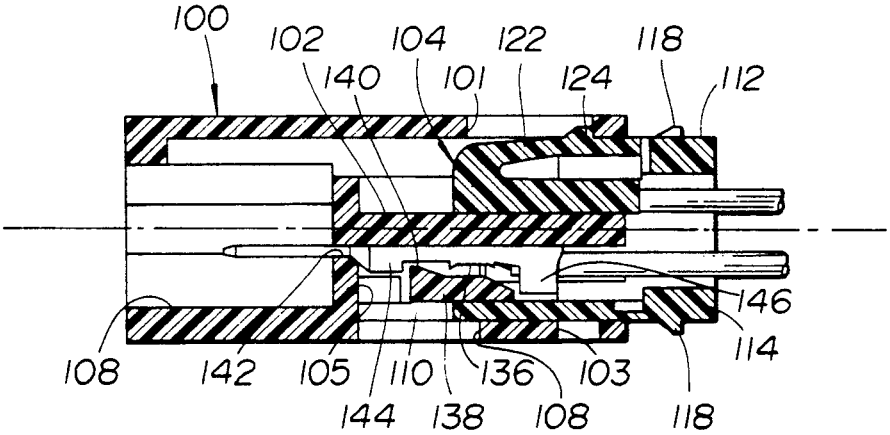
FIG. 12 is a view similar to FIG. 5, but showing the second embodiment.
Figure 13:
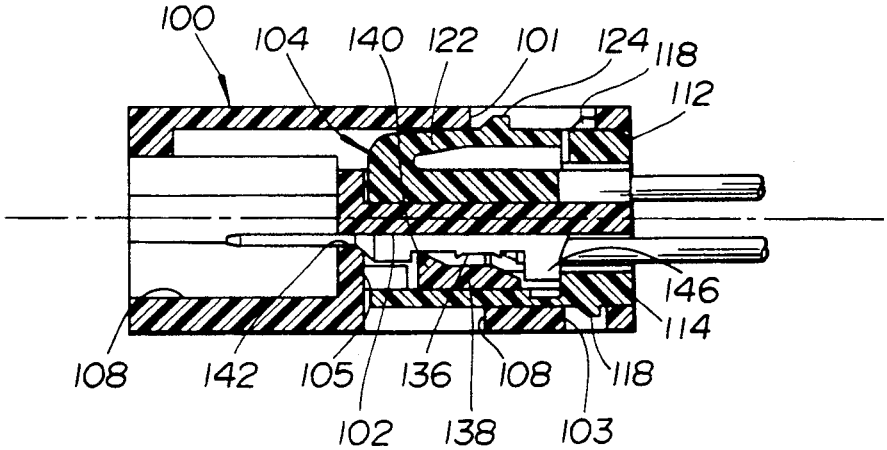
FIG. 13 is a view similar to FIG. 6, but showing the second embodiment.
Figure 14:
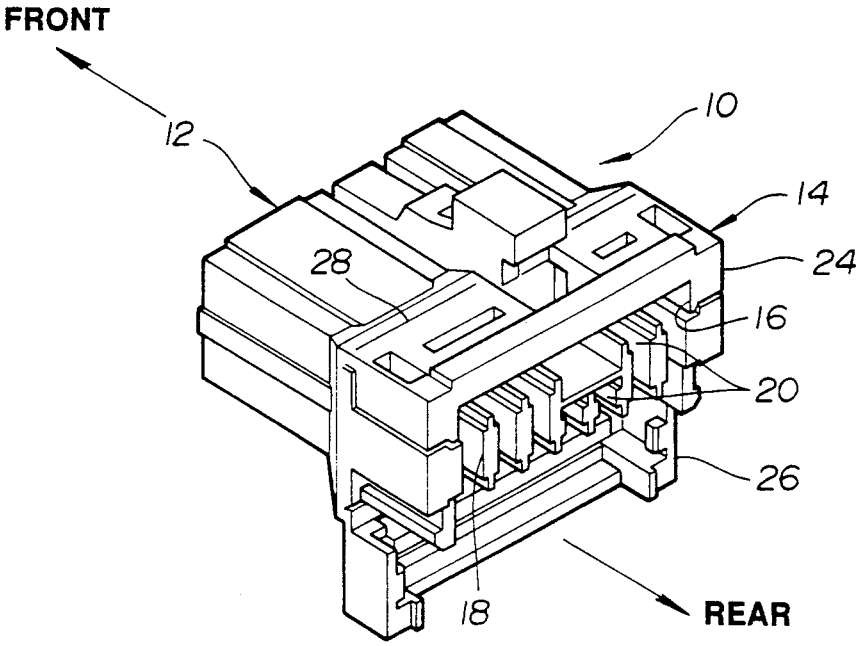
FIG. 14 (PRIOR ART)
FIG. 14 is a perspective view of a conventional electric connector, showing a condition wherein an upper portion of a rear larger portion is closed and a lower portion of the rear larger portion is opened.
Figure 16:
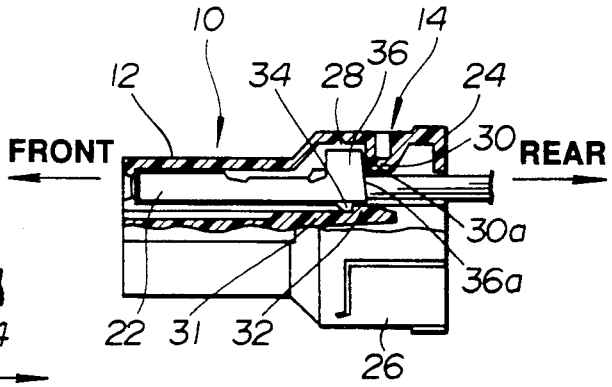
FIG. 16 (PRIOR ART)
FIG. 16 is a view similar to FIGS. 5 and 6, but showing the conventional electrical connector.
Figure 15:
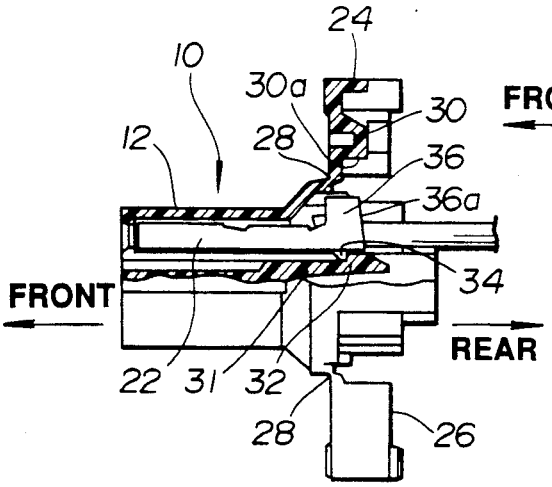
FIG. 15 (PRIOR ART)
FIG. 15 is a view similar to FIG. 4, but showing the conventional electrical connector.

As is seen from FIGS. 11, 12 and 13, the terminal support 102 is formed at each terminal passage 134 with a flexible arm 138 which has an inwardly projected portion 140 (see FIG. 7). The projected portion 140 of the arm 138 is used for locking the terminal 136 as is described for the first embodiment.

The middle vertical wall 105 of the housing 100 is formed with upper and lower holes 142 for permitting insertion of leading portions of the terminals 136 into the front cavity 108 of the housing 100.

The terminal 136 is an elongate metal member and has projections 144 and 146 at a middle portion and a rear end thereof, respectively.

Installation of the terminals 136 to the electrical connector will be described with reference to the drawings.

First, as is seen from FIG. 7, the upper and lower terminal-holding portions 112 and 114 of the terminal holder 104 are opened. Then, the terminal holder 104 is slidably received into the rear cavity 110 of the housing 100 and brought to an incompletely latched position wherein the projection 124 of the terminal holder 104 is engaged with the opening 101 of the housing 100. Under this condition, the front surfaces of the upper and lower terminal-holding portions 112 and 114 are in abutment with the rear end surfaces of the housing 100. Then, the terminals 136 are inserted into the passages 134 of the terminal support 102 from the rear open ends of the passages 134. This inserting movement is continued until the projections 144 of the terminals 136 ride over the inwardly projected portions 140 of the terminal supports 40. Under this condition, the projections 144 of the terminals 136 are held between the middle wall 105 of the housing 100 and the projected portions 140 of the terminal support 102, as is shown in FIG. 11.

Then, as is seen from FIG. 12, the upper and lower terminal-holding portions 112 and 114 are pivoted to assume the closed positions. Under this condition, the vertical front surfaces of upper and lower terminal-holding portions 112 and 114 face toward rear ends of the projections 146 of the terminals 136 with a certain clearance therebetween.

Figure 10:
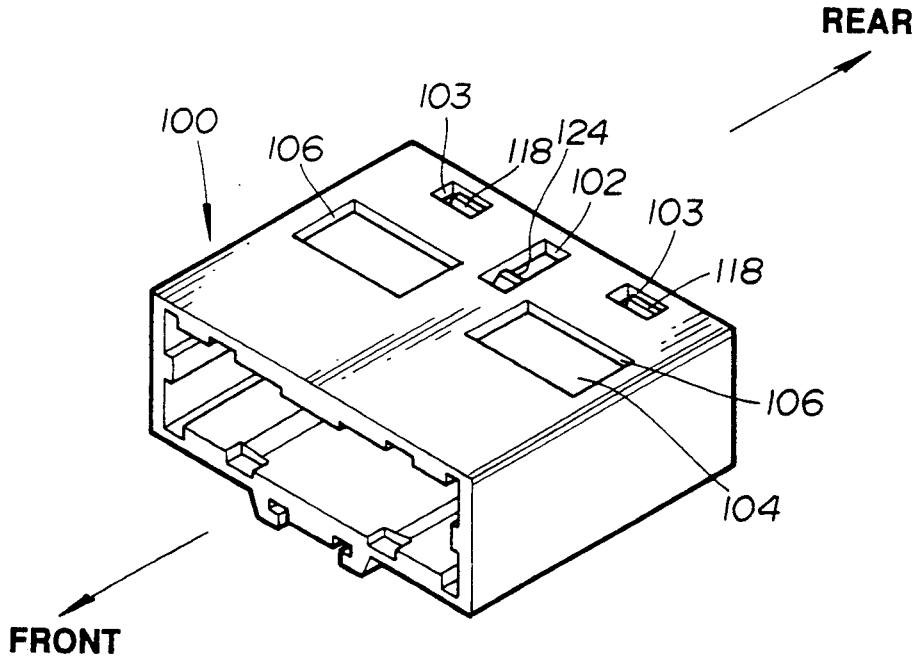
FIG. 10 is a view similar to FIG. 9, but showing a condition wherein the terminal holder is in a complete coupling with the housing.

Then, as is seen from FIG. 10 and 13, the terminal holder 104 is forwardly slid to the so-called completely latched position wherein the projections 118 of the terminal holder 104 are lockably engaged with the openings 103 of the housing 100. With this, the terminal holder 104 is tightly fixed to the housing 100. Under this condition, the vertical front surfaces of the upper and lower terminal-holding portions 112 and 114 are in abutment with or at least positioned adjacent to the rear ends of the projections 146 of the terminals 136.

In the following, the advantage of the first and second embodiment of the present invention over the conventional electrical connector will be described.

That is, even if some of the terminals are kept inproperly set in the passages, the closing pivoting of the upper and lower terminal-holding portions is permitted because of the clearance between the rear ends of the terminals and the upper and lower terminal-holding portions. The upper and lower terminal-holding portions can then forwardly push the terminals to their proper positions by means of the forward slide of the terminal holder. Therefore, inproper setting of the terminals in the passages and the damage of the terminals due to an abnormal abutment with the upper and lower terminal-holding portions can be prevented.

What is claimed is:

1. An electrical connector assembly comprising:

a connector housing;

a terminal support integrally connected to said connector housing, said terminal support having therein a plurality of abreast arranged passages;

a plurality of terminals adapted to be received in said passages;

a terminal holder having a rear open end and a through bore which is so sized as to receive therein said terminal support;

a pair of openable portions defined by rear portions of said terminal holder said openable portions having a closed condition wherein said openable portions partially close the rear open end of said through bore and an open condition wherein said openable portions fully open said rear open end;

first latching means for incompletely latching said terminal holder to either said connector housing or said terminal support when said terminal holder is slid on said terminal support with said openable portions assuming said open condition, to a first given position relative to said terminal support, said first given position permitting easy insertion of said terminals into said passages of said terminal support from said rear open end; and second latching means for completely latching said terminal holder to either said connector housing or said terminal support when said terminal holder is slid on said terminal support, with said openable portions assuming said closed condition, from said first given position to a second given position to fully receive said terminal support.

2. An electrical connector assembly as claimed in claim 1, in which said terminal is formed with first and second projections at a middle portion and a rear end thereof, respectively, and in which said terminal support is formed with a plurality of flexible arms having inwardly projected portions, said first projection being lockably engaged with said inwardly projected portion when said terminal is kept properly received in said passage.

3. An electrical connector assembly as claimed in claim 2, in which, when said terminal holder is slid, with said openable portions assuming said closed condition, to said second given position, said openable portions are in abutment with or at least positioned adjacent to a rear end of said second projection of said terminal.

4. An electrical connector assembly as claimed in claim 3, in which said connector housing is integrally formed with a vertical wall with which said terminal support is integral, and in which said vertical wall has means for defining a plurality of holes therein for receiving said terminals, said first projection of said terminal being held between said vertical wall and said inwardly projected portion of said terminal support when said terminal is kept properly received in said passage.

5. An electrical connector assembly as claimed in claim 4, in which said openable portions are integral with said terminal holder by means of integral hinges therebetween.

6. An electrical connector assembly as claimed in claim 5, in which said terminal holder is adapted to be incompletely and completely latched to said terminal support by said first and second latching means, respectively, said terminal support being integrally connected to said connector housing in a manner to coaxially project therefrom.

7. An electrical connector assembly as claimed in Claim 6, in which said terminal supports are united by a depressed portion therebetween and said first latching means comprises:

third projections defined by both side surfaces of said terminal supports; and fourth projections defined by front ends of both inner side surfaces of said terminal holder, said third projections being lockably engaged with said fourth projections when said terminal holder is incompletely latched to said terminal support.

8. An electrical connector assembly as claimed in claim 7, in which said second latching means comprises:

fifth projections defined by upper and lower surfaces of said depressed portion; and sixth projections defined by front middle portions of upper and lower inner surfaces of said terminal holder, said sixth projections being lockably engaged with said fifth projections when said terminal holder is completely latched to said terminal support.

9. An electrical connector assembly as claimed in claim 8, in which said openable portion is formed at rear end thereof with a projected portion which is inwardly bent, said projected portion being in abutment or at least positioned adjacent to a rear end of said second projection of said terminal when said terminal holder is completely latched to said terminal support with said openable portions assuming said closed condition.

10. An electrical connector assembly as claimed in claim 5, in which said terminal holder is adapted to be incompletely and completely latched to said connector housing by said first and second latching means, respectively.

11. An electrical connector assembly as claimed in claim 10, in which said first latching means comprises:

a first opening defined by a rear middle portion of an upper surface of said connector housing; and a seventh projection defined by said terminal holder, said seventh projection being lockably engaged with said first opening when said terminal holder is incompletely latched to said connector housing, wherein said seventh projection is further define by a rear portion of a L-shaped arm which is flexible, said L-shaped arm being received in a concave portion which is defined by a middle portion of an upper surface of said terminal holder.

12. An electrical connector assembly as claimed in claim 11, in which said second latching means comprises:

eighth projections defined by said openable portions; and second openings defined by rear portions of upper and lower surfaces of said connector housing, said second openings being lockably engaged with said eighth projections when said terminal holder is completely latched to said connector housing.

13. An electrical connector assembly as claimed in claim 12, in which front surfaces of said openable portions are in abutment or at least positioned adjacent to a rear end of said second projection of said terminal when said terminal holder is completely latched to said connector housing with said openable portions assuming said closed condition.

14. An electrical connector assembly as claimed in claim 13, in which, when said terminal holder is incompletely latched to said connector housing with said openable portions assuming said opened condition, front surfaces of said openable portions are in abutment with a rear end surface of said connector housing, so as to prevent said terminal holder from being completely latched to said connector housing when said openable portions are in said opened condition.

15. An electrical connector assembly as claimed in claim 14, in which, when said terminal holder is completely latched to said connector housing, said terminal holder is fully received in said connector housing.

16. An electrical connector assembly comprising:

a connector housing;

two terminal supports integrally connected to said connector housing, said terminal supports having therein a plurality of abreast arranged passages, said terminal supports being united by a depressed portion therebetween;

a plurality of terminals adapted to be received in said passages;

a terminal holder having a rear open end and a through bore which is so sized as to receive therein said terminal supports;

a pair of openable portions defined by a rear portions of said terminal holder, said openable portions having a closed condition wherein said openable portions partially close the rear open end of said through bore and an open condition wherein said openable portions fully open the rear open end;

first latching means for incompletely latching said terminal holder to either said connector housing or said terminal supports when said terminal holder is slid relative to said terminal supports, with said openable portions assuming said open condition, to a first given position, said first given position permitting easy insertion of said terminals into said passages of said terminal supports from the rear open end; and second latching means for completely latching said terminal holder to either said connector housing or said terminal supports when said terminal holder is slid relative to said terminal supports, with said openable portions assuming said closed condition, from said first given position to a second given position to fully receive said terminal supports.

17. An electrical connector assembly comprising:

a connector housing;

a terminal support integrally connected to said connector housing, said terminal support having therein a plurality of abreast arranged passages;

a plurality of terminals adapted to be received in said passages;

a terminal holder having a rear open end and a through bore which is so sized as to receive therein said terminal support;

a pair of openable portions defined by a rear portions of said terminal holder, said openable portions having a closed condition wherein said openable portions partially close the rear open end of said through bore and an open condition wherein said openable portions fully open the rear open end;

first latching means for incompletely latching said terminal holder to either said connector housing or said terminal support when said terminal holder is slid relative to said terminal support, with said openable portions assuming said open condition, to a first given position, said first given position permitting easy insertion of said terminals into said passages of said terminal support from the rear open end, said first latching means comprising:

first opening defined by a rear middle portion of an upper surface of said connector housing; and a projection defined by said terminal holder, said projection being lockably engaged with said first opening when said terminal holder is incompletely latched to said connector housing; and second latching means for completely latching said terminal holder to either said connector housing or said terminal support when said terminal holder is slid relative to said terminal support, with said openable portion assuming said closed condition, from said first given position to a second given position to fully receive said terminal support.

18. An electrical connector assembly comprising:

a connector housing;

a terminal support integrally connected to said connector housing, said terminal support having therein a plurality of abreast arranged passages;

a plurality of terminals adapted to be received in said passages;

a terminal holder having a rear open end and a through bore which is so sized as to receive therein said terminal support;

an openable portion defined by rear portions of said terminal holder said openable portion having a closed condition wherein said openable portion partially closes the rear open end of said through bore and an open condition wherein said openable portion fully opens said rear open end;

first latching means for incompletely latching said terminal holder either of said connector housing or said terminal support when said terminal holder is slid on said terminal support, with said openable portion assuming said open condition, to a first given position relative to said terminal support, said first given position permitting easy insertion of said terminals into said passages of said terminal support from said rear open end; and second latching means for completely latching said terminal holder to either said connector housing or said terminal support when said terminal holder is slid on said terminal support, with said openable portion assuming said closed condition, from said first given position to a second given position to fully receive said terminal support.

19. An electrical connector assembly comprising:

a connector housing;

a terminal support integrally connected to said connector housing, said terminal support having therein a passage;

a terminal adapted to be received in said passage, said terminal having a projected portion;

a terminal holder having a rear open end and a through bore which is so sized as to receive therein said terminal support;

an openable portion defined by a rear portion of said terminal holder, said openable portion having a closed condition wherein said openable portion partially closes the rear open end of said through bore and an open condition wherein said openable portion opens the rear open end, said openable portion being engageable with the projected portion of said terminal;

first latching means for incompletely latching said terminal holder to either said connector housing or said terminal support when said terminal holder is slid relative to said terminal support, with said openable portion assuming said open condition, to a first given position, said first given position permitting easy insert of said terminal into said passage of said terminal support from the rear open end; and second latching means for completely latching said terminal holder to either said connector housing or said terminal support when said terminal holder is slid relative to said terminal support, with said openable portion assuming said closed condition, from said first given position to a second given position.

20. An electrical connector assembly as claimed in claim 19, in which, when said terminal is incompletely inserted into the passage, said terminal is pushed to a proper position thereof by sliding movement of said terminal holder from said first given position to said second given position.

21. An electrical connector assembly as claimed in claim 20, in which, when said terminal is pushed by said terminal holder, force on said terminal is exerted by said terminal holder in a direction parallel to an axis of said terminal.

22. An electrical connector assembly as claim in claim 21, in which said terminal holder has a projection which is opposed to said projected portion of said terminal under said closed condition, thereby assuring a proper abutment between said projected portion and said projection.

23. An electrical connector assembly as claimed in claim 19, in which said terminal holder is slidable from said first given position to said second given position in a direction parallel to an axis of said terminal.

* * * * *